United States Patent [19]

Holtrop

[11] 4,005,632

[45] Feb. 1, 1977

[54] LIQUID PROPELLANT GUN

[75] Inventor: John W. Holtrop, Ridgecrest, Calif.

[73] Assignee: The United States of America as represented by the Secretary of the Navy, Washington, D.C.

[22] Filed: Sept. 15, 1975

[21] Appl. No.: 613,690

[52] U.S. Cl. ..... 89/7; 89/24

[51] Int. Cl.[2] ..... F41F 1/04

[58] Field of Search ..... 89/7, 24, 4 B

[56] References Cited

UNITED STATES PATENTS

| | | | |
|---|---|---|---|
| 830,825 | 9/1906 | Dearborn | 89/24 X |
| 2,789,472 | 4/1957 | Warlick | 89/24 X |
| 3,138,990 | 6/1964 | Jukes et al. | 89/7 |
| 3,160,064 | 12/1964 | Bell et al. | 89/7 X |
| 3,763,739 | 10/1973 | Tassie | 89/7 |
| 3,803,975 | 4/1974 | Elmore et al. | 89/7 |

*Primary Examiner*—David H. Brown

*Attorney, Agent, or Firm*—R. S. Sciascia; Roy Miller; G. F. Baker

[57] ABSTRACT

The injector assembly for liquid propellant guns is slidably mounted for movement into or out of the firing chamber of the gun as a sliding breech block. The bolt is movable within the injector assembly in one portion and the firing device is chambered in the alternate portion of the block.

4 Claims, 3 Drawing Figures

LIQUID PROPELLANT GUN

BACKGROUND OF THE INVENTION

The present invention relates to liquid propellant guns and particularly to an injector assembly therefor. The invention has for an object thereof the prevention of back pressure on the injector mechanism.

Previous designs, for example, have subjected the injection mechanism to firing pressures. To survive firing, these components had to be small. This limited the propellant flow areas, slowing injection and rate of fire. Additionally, flow passages were left exposed, allowing ullage, unburned propellant, and structural weakening. Guns of this type have been known to fail by hot gas leakage into the injector mechanism often with resulting spontaneous disassembly.

The present invention is an improvement over the prior liquid propellant gun design disclosed in Assignee's prior application Ser. No. 612,817 filed Sept. 12, 1975 and identified as Navy Case No. 57678.

The design in assignee's prior application referenced above protects the injector mechanism by advancing the bolt to block the firing pressure. In other words, after injection, the bolt is moved forward translating the projectile, propellant charge, and bolt mechanism down bore until the end of the bolt is ahead of the injector. The bolt mechanism must then stop and lock the gun before firing. This protects the injector, but the bolt actuation and locking system is complicated and must be heavy enough to withstand firing pressures. Power requirements are high and the rate of fire is reduced as a consequence of the stop-start action.

SUMMARY OF THE INVENTION

According to the present invention the injector mechanism is protected from firing pressures by a device in the form of a sliding block. The injector mechanism and bolt are in one portion of the block and the firing device is in a second portion of the block. After injection, the block is moved to a position with the injector mechanism and bolt out of line with the barrel and with the firing device then in line with the barrel. Sliding the injector completely away from the high pressure area protects it and the propellant supply system from the high pressures and dangers of fuel or gas leakage. There are no passages, slots or holes exposed to propellant and breech pressures during firing. This eliminates pockets of trapped propellant as well as ullage and increases the strength of the high pressure area.

This arrangement also results in a short compact design well adapted to large caliber guns where a long bolt assembly would be unwieldy. Accordingly, the sliding breech block type injector module simplifies liquid propellant gun design by eliminating the complex bolt, bolt actuation, bolt jog and bolt lock of the prior mechanism resulting in faster firing rates made possible because the moving parts are smaller, lighter and moved through shorter distances.

DESCRIPTION AND OPERATION

Figure 1:
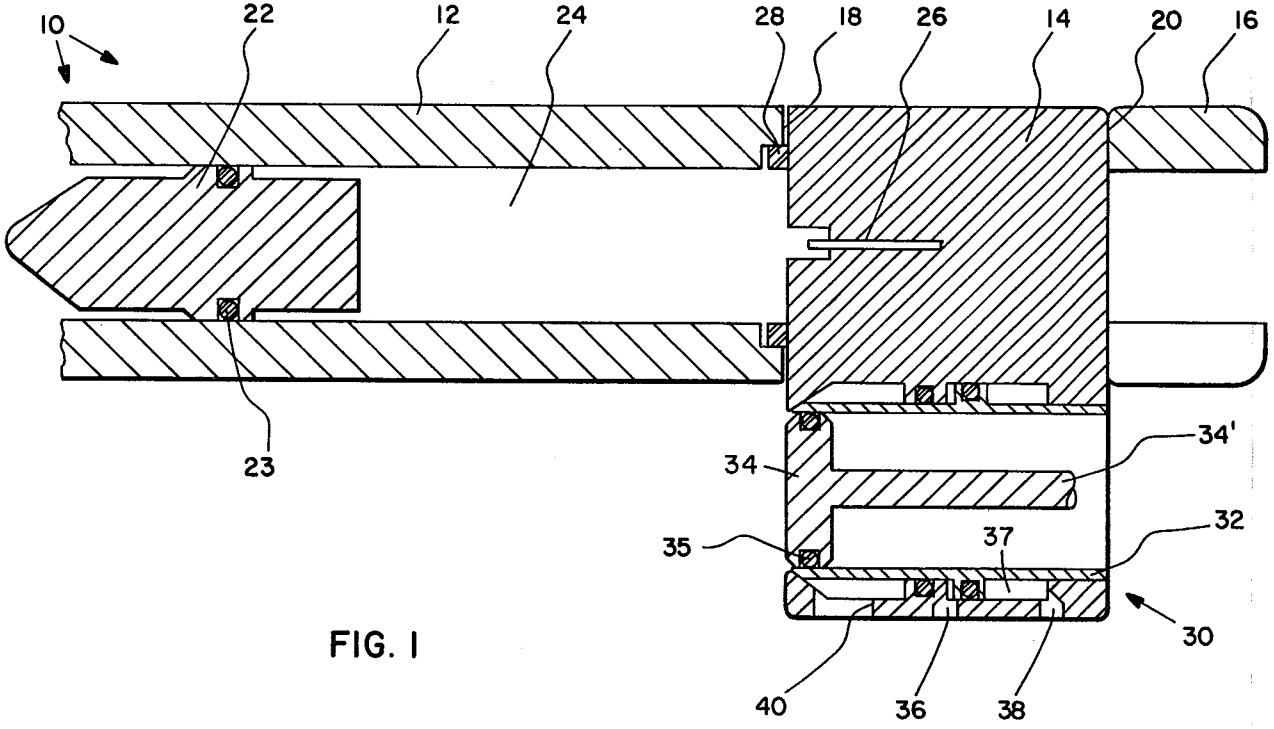
FIG. 1 is a longitudinal cross sectional view of the breech area of a liquid propellant gun according to the invention designed to fire caseless ammunition.

The breech area of a liquid propellant gun according to the invention is indicated generally by the numeral 10 in FIG. 1. The breech end of the barrel is indicated at 12, the breech block at 14 and the magazine side of the breech at 16. The block 14 slides in a slot 18 provided in the barrel-breech area the rear portion 20 of which slot provides the locking or reaction surface during firing.

The parts are shown in position ready for firing with the projectile 22 forward of the block 14 and presumably with the fuel chamber area 24 filled with liquid propellant fuel. The fuel is ignited by a spark igniter 26 which is shown chambered within the sliding block 14.

A circumferential breech seal 28 is recessed in the breech end of barrel 12 and is designed to react to the rising propellant pressures preventing the escape of the products of combustion.

The injector assembly 30 is located in the lower portion of block 14 and consists of a circumferential injection valve 32 coaxial with the projectile ram or bolt 34 and bolt actuator 34'. Movement of the injection valve 32 is accomplished by changing pressure in one side or the other of hydraulic control chamber 37 with hydraulic means through ports 36, 38 and the liquid propellant is supplied under pressure through the port 40 into the area 41 which is a part of the fuel chamber when block 14 is in the injection position.

With the parts in the position shown in FIG. 1, when it is desired to fire another projectile, the breech block 14 is shifted upwards until the axis of the injector valve 32 is in line with the bore. The projectile ram 34 is simultaneously withdrawn to pick up a new round from the magazine and then returns to ram the round into the breech block area. When the liquid seal 23 on the projectile 22 enters the barrel 12 the ram 34 is halted. The injection valve 32 is next opened by hydraulic signals through port 36 allowing an external pump to deliver a new charge of propellant. The new charge enters through a port 40 in the breech block and flows into the space between the projectile and ram. The liquid seal 35 on the ram 34 along with the seals 23 and 28 on the projectile and the breech end of the barrel respectively prevent leakage as the projectile is pumped into its firing position as shown in FIG. 1. After injection, the valve 32 is closed by hydraulic action and the ram moved forward until flush with the breech block as the breech block is shifted back to its position, as shown in FIG. 1, and the gun is ready to fire. The breech seal 28 is under pressure at this time and prevents leakage as the breech block shifts.

Figures 2, 3:
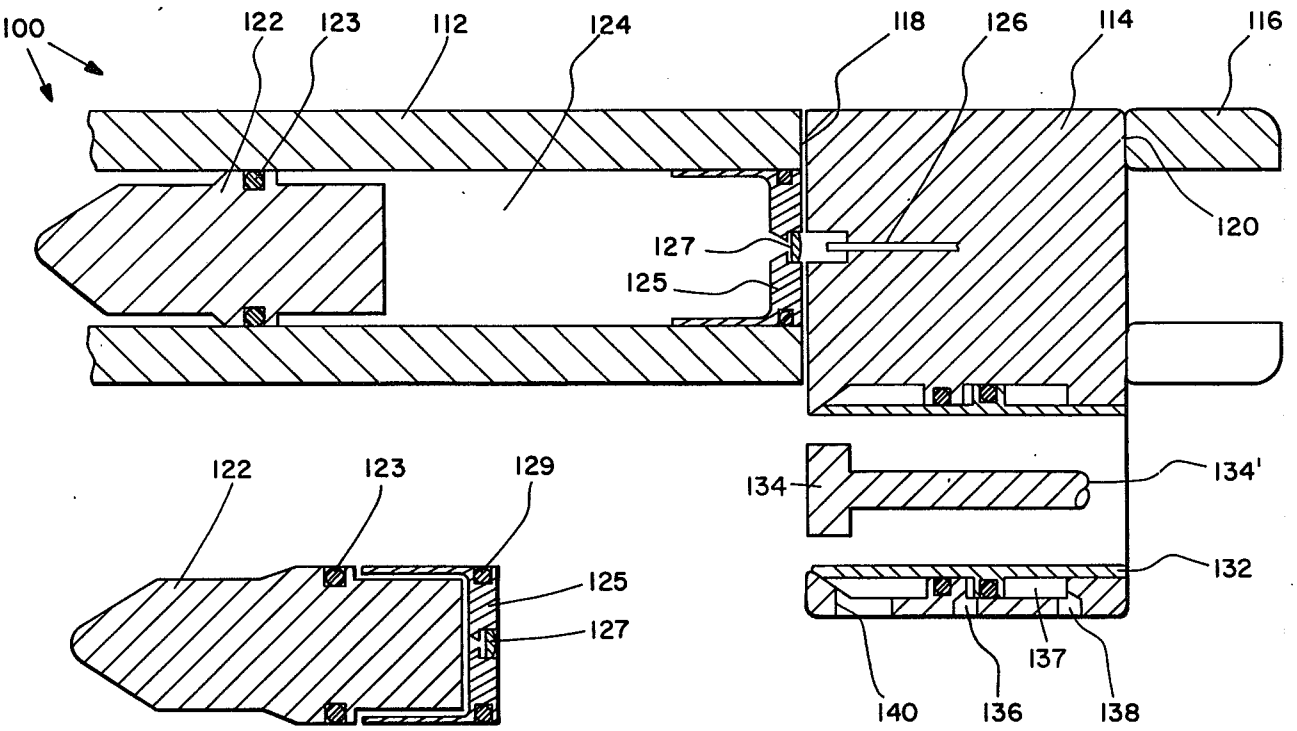
FIG. 2 is a view similar to FIG. 1 of a modification for firing semi-cased projectiles.
FIG. 3 is a longitudinal cross sectional view of a semi-cased projectile useable in the device of FIG. 2.

A modified liquid propellant gun is generally indicated in FIG. 2 by the numeral 100. The FIG. 2 device operates in all respects as the device of FIG. 1 with a few exceptions.

The projectile 22 which is used in the FIG. 2 devices comes equipped with a short case 125 as shown in FIG. 3. The case 125 is equipped with a standard pyrotechnic ignition system 127 and a sealing ring 129. The case 125 is assembled to projectile 122 with a fit light enough to insure relative separation during injection. After injection, the case, propellant charge, and projectile are rammed to the firing position shown in FIG. 2.

With this arrangement the breech end of the barrel and the ram need not be fitted with seals and the ram 134 may be modified to include a case extractor.

This arrangement simplified the gun design by providing a new high pressure breech seal and igniter for each slot. Additionally, the projectile base is enclosed and protected by the semi-case feature which advantageously protects the fuze, fins, rocket motor or guidance mechanisms in more complex projectiles.

What is claimed is:

1. In a gun, a sliding breech block movable between a firing position and a loading position, a firing device chambered in a first portion of said block, valve means including a cylindrical valve slidably mounted in a second portion of said block and defining with said second block portion a fuel chamber and a hydraulic control chamber, so that said valve means is removed from the breech area when the gun is in said firing position ready to be fired by said firing device.

2. The gun according to claim 1 further including:

a forward breech portion receiving a tubular barrel, a rearward breech portion having a bore, a bolt and bolt actuator mounted for sliding action in said bore and movable from a position wholly within said bore to a position within said second block portion when said block is in said loading position.

3. The gun of claim 2 further including:

a first obturating seal in said barrel at the juncture of said forward breech portion and said block and a second obturating seal on the forward end of said bolt.

4. In a liquid propellant gun for firing semi-cased or uncased rounds, the combination comprising:

a gun barrel;

a breech;

a breech block slidably received in said breech and movable from a first position for firing and a second position for loading;

a firing device chambered in said block such as to be placed substantially concentric to and in communication with the bore of said barrel when said block is in said first position;

a cylindrical valve slidably mounted in said block such that said valve is placed concentric to and communicating with the bore of said barrel when said block is in said second position;

a bolt and bolt actuator associated with said block such that said bolt is slidably received within said valve so that;

when said block is in said first position, said firing device may be actuated for firing a projectile; and when said block is in said second position, said bolt may be reciprocated to reload the gun.

* * * * *